US010191414B2

(12) United States Patent
Nedelin et al.

(10) Patent No.: US 10,191,414 B2
(45) Date of Patent: Jan. 29, 2019

(54) ELECTROPHOTOGRAPHIC PRINTERS

(71) Applicant: HP INDIGO B.V., Amstelveen (NL)

(72) Inventors: Peter Nedelin, Ashdod (IL); Mark Sandler, Rehovot (IL); Shai Lior, Rehovot (IL)

(73) Assignee: HP INDIGO B.V., Amstelveen (NL)

( * ) Notice: Subject to any disclaimer, the term of this patent is extended or adjusted under 35 U.S.C. 154(b) by 0 days.

(21) Appl. No.: 15/569,319

(22) PCT Filed: Jul. 28, 2015

(86) PCT No.: PCT/EP2015/067316
§ 371 (c)(1),
(2) Date: Oct. 25, 2017

(87) PCT Pub. No.: WO2017/016599
PCT Pub. Date: Feb. 2, 2017

(65) Prior Publication Data

US 2018/0129151 A1 May 10, 2018

(51) Int. Cl.

| | |
|---|---|
| ***G03G 15/10*** | (2006.01) |
| ***G03G 15/14*** | (2006.01) |
| ***G03G 15/16*** | (2006.01) |

(52) U.S. Cl.
CPC ..... *G03G 15/10* (2013.01); *G03G 15/14* (2013.01); *G03G 15/161* (2013.01); *G03G 2215/025* (2013.01); *G03G 2215/027* (2013.01); *G03G 2215/0631* (2013.01); *G03G 2215/16* (2013.01); *G03G 2215/1685* (2013.01)

(58) Field of Classification Search
CPC .... G03G 15/11; G03G 15/161; G03G 15/201; G03G 2215/1671
See application file for complete search history.

(56) References Cited

U.S. PATENT DOCUMENTS

| | | | | |
|---|---|---|---|---|
| 3,893,761 | A | 7/1975 | Buchan et al. | |
| 5,258,776 | A | 11/1993 | Guy et al. | |
| 5,436,710 | A * | 7/1995 | Uchiyama ..... | G03G 15/2007 219/216 |
| 5,914,741 | A | 6/1999 | Snelling et al. | |
| 7,440,722 | B2 | 10/2008 | Lofthus et al. | |

(Continued)

FOREIGN PATENT DOCUMENTS

| | | |
|---|---|---|
| EP | 1079281 | 2/2001 |
| EP | 2423761 | 2/2001 |
| WO | WO-2015023262 | 2/2015 |

OTHER PUBLICATIONS

Printers, Nov. 17, 2013, Available Online: (http://users.utcluj.ro/~baruch/media/siee/labor/Printers.pdf).

*Primary Examiner* — Ryan D Walsh
(74) *Attorney, Agent, or Firm* — HP Inc. Patent Department

(57) ABSTRACT

A method of operating an electrophotographic printer (100) to control the optical density of a printed image is described. The method comprises providing a printing substance on a transfer member (104); emitting a pulse of heat to heat the printing substance on the transfer member to increase flowability of the printing substance on the transfer member; and transferring, from the transfer member to a substrate (108), the printing substance heated by the pulse of heat so as to provide the printed image on the substrate.

17 Claims, 7 Drawing Sheets

(56) References Cited

U.S. PATENT DOCUMENTS

| | | | | |
|---|---|---|---|---|
| 8,406,672 | B2 | 3/2013 | Tyagi | |
| 2005/0025534 | A1* | 2/2005 | Fujita | G03G 15/1665 399/307 |
| 2009/0035458 | A1* | 2/2009 | Yoshie | G03G 15/11 427/145 |
| 2010/0028064 | A1 | 2/2010 | Shiozawa | |
| 2014/0026771 | A1 | 1/2014 | Schlumm et al. | |
| 2015/0165759 | A1* | 6/2015 | Landa | B41J 2/0057 347/103 |

* cited by examiner

ELECTROPHOTOGRAPHIC PRINTERS

BACKGROUND

An electrophotographic printing system may use digitally controlled lasers to create a latent image in the charged surface of a photo imaging plate (PIP). The lasers are controlled according to digital instructions from a digital image file. Digital instructions typically include one or more of the following parameters: image colour, image spacing, image intensity, order of the colour layers, etc. A printing substance is then applied to the partially-charged surface of the PIP, recreating the desired image. The image is then transferred from the PIP to a transfer blanket on a transfer cylinder and from the transfer blanket to the desired substrate, which is placed into contact with the transfer blanket by an impression cylinder.

BRIEF DESCRIPTION OF THE DRAWINGS

Various features of the present disclosure will be apparent from the detailed description which follows, taken in conjunction with the accompanying drawings, which together illustrate, by way of example only, features of the present disclosure, and wherein.

DETAILED DESCRIPTION

In the following description, for purposes of explanation, numerous specific details are set forth in order to provide a thorough understanding of the present systems and methods. It will be apparent, however, that the present apparatus, systems and methods may be practiced without these specific details. Reference in the specification to "an example" or similar language means that a particular feature, structure, or characteristic described in connection with the example is included in at least that one example, but not necessarily in other examples.

Figure 1:
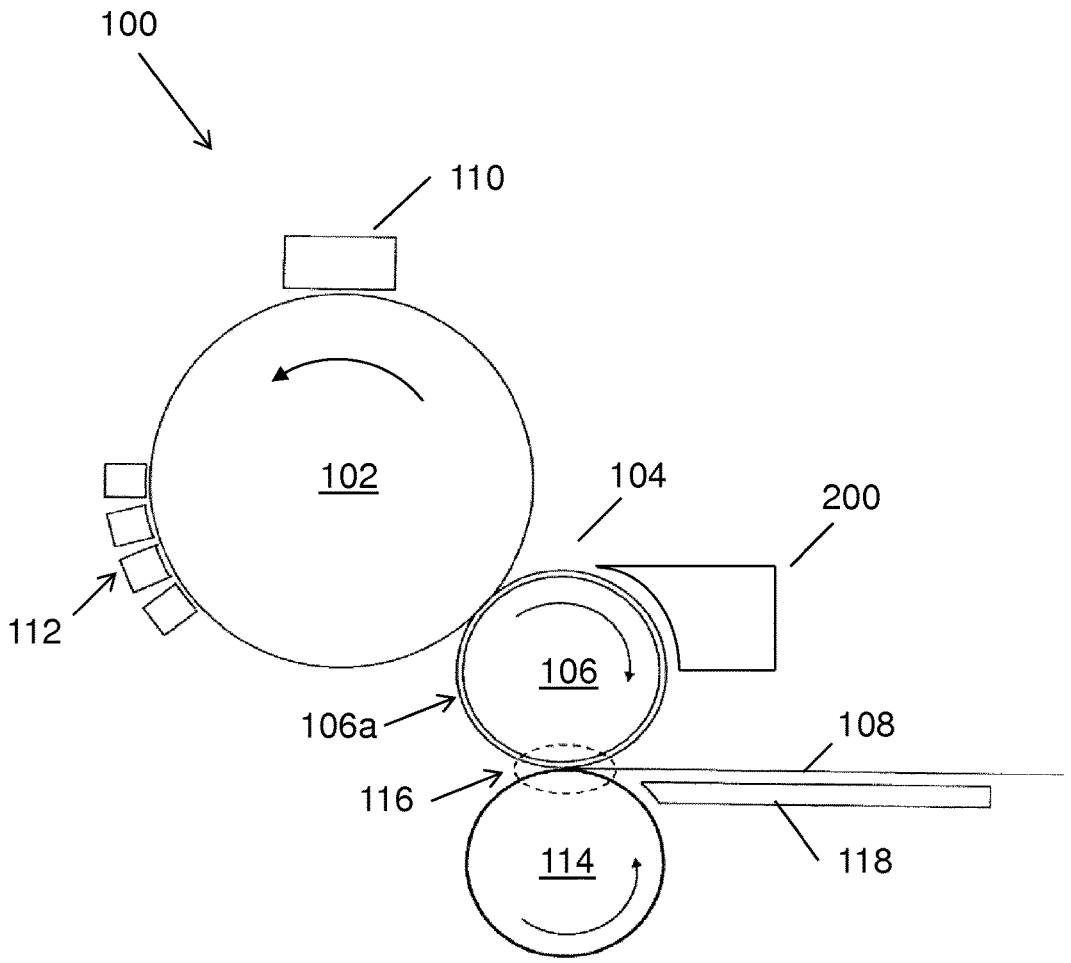
FIG. 1 is a schematic diagram showing an electrophotographic printer in accordance with an example.

FIG. 1 is a schematic diagram of an electrophotographic printer 100 according to one example to print a desired image. In various implementations, the desired image may be communicated to the printer 100 in digital form. As such, the desired image may include any combination of text, graphics and images.

Electrophotographic printing refers to a process of printing in which a printing substance (e.g., a liquid or dry electrophotographic ink or toner) can be applied onto a surface having a pattern of electrostatic charge. The printing substance conforms to the electrostatic charge to form an image in the printing substance that corresponds to the electrostatic charge pattern. For example, in the example electrophotographic system 100 of FIG. 1, the desired image is initially formed on a photo-imaging cylinder 102 using a printing substance, such as liquid ink. The printing substance, in the form of the image, is then transferred from the photo-imaging cylinder 102 to an intermediate surface, such as the surface of a transfer element 104. The photo-imaging cylinder 102 may continue to rotate, passing through various stations to form the next image.

In the example depicted in FIG. 1, the transfer element 104 comprises a transfer cylinder 106 and a transfer blanket 106*a* surrounding the transfer cylinder 106, and the surface of the transfer element 104 is a surface of the transfer blanket 106*a*. The transfer element may otherwise be referred to as a transfer member 104.

In various examples, the printing substance on the transfer member 104, and the printing substance image can be heated by a heater 200. The heater 200 and the heating process will be described in more detail below. In this example, the image can then be transferred from the transfer blanket 106*a* to a substrate 108. In other examples, the transfer member 104 may not include a transfer blanket.

Under certain conditions and when particular printing substances are used, images printed on a substrate can appear as unsaturated and matte. This can occur when the image on the substrate has limited optical density and gloss due to non-uniformity of the ink layer thickness. The non-uniformity of the ink layer thickness can result in voids in the ink layer, which appear as a spots in the printed image. For example, for images printed on a white substrates, such as paper, vinyl, latex, and the like, the voids in the ink layer can appear as white spots in the printed image. Implementations of the present disclosure can improve the optical density and gloss of electrophotographically printed images while avoiding excess printing substance consumption and any additional steps for coating or treating the printed image.

According to one example, an image is formed on the photo-imaging cylinder 102 by rotating a clean, bare segment of the photo-imaging cylinder 102 under a photo charging unit 110. The photo charging unit 110 may include a charging device, such as corona wire, charge roller, or other charging device, and a laser imaging portion. A uniform static charge may be deposited on the photo-imaging cylinder 102 by the photo charging unit 110. As the photo-imaging cylinder 102 continues to rotate, the photo-imaging cylinder 102 passes the laser imaging portion of the photo charging unit 110 that may dissipate localised charge in selected portions of the photo-imaging cylinder 102 to leave an invisible electrostatic charge pattern that corresponding to the image to be printed. In some examples, the photo charging unit 110 applies a negative charge to the surface of the photo-imaging cylinder 102. In other examples, the charge may be a positive charge. The laser imaging portion of the photo charging unit 110 may then locally discharge portions of the photo imaging cylinder 102, resulting in local neutralised regions on the photo-imaging cylinder 102.

In this example, a printing substance is transferred onto the photo-imaging cylinder 102 by Binary Ink Developer (BID) units 112. In some examples, the printing substance is liquid ink. In other examples the printing substance may be other than liquid ink, such as toner. In this example, there is one BID unit 112 for each printing substance colour. During printing, the appropriate BID unit 112 is engaged with the photo-imaging cylinder 102. The engaged BID unit 112 may present a uniform film of printing substance to the photo-imaging cylinder 102.

The printing substance may comprise electrically charged pigment particles that are attracted to the oppositely charged electrical fields on the image areas of the photo-imaging cylinder 102. The printing substance may be repelled from the charged, non-image areas. The result is that the photo-imaging cylinder 102 is provided with the image, in the form of an appropriate pattern of the printing substance, on its surface. In other examples, such as those for black and white (monochromatic) printing, one or more ink developer units may alternatively be provided.

One example of an electrophotographic printer is a digital offset printing system, otherwise known as a Liquid Electrophotographic (LEP) printing system. In an LEP system, the printing substance may be liquid ink, such as electroink. In electroink, ink particles are suspended in a liquid carrier. In one example, ink particles are incorporated into a resin that is suspended in a carrier liquid, such as Isopar. The ink particles may be electrically charged such that they can be controlled when subjected to an electric field. Typically, the ink particles are negatively charged and are therefore repelled from the negatively charged portions of the photo imaging cylinder 102, and are attracted to the discharged portions of the photo imaging cylinder 102. The ink may be incorporated into the resin and the compound particles may be suspended in the carrier liquid. The dimensions of the ink particles may be such that the printed image does not mask the underlying texture of the substrate 108, so that the finish of the print is consistent with the finish of the substrate 108, rather than masking the substrate 108. This enables LEP printing to produce finishes closer in appearance to offset lithography, in which ink is absorbed into the substrate 108. In some examples, the printing substance may be dry toner comprising ink particles in powder form. In other examples, the printing substance may comprise ink particles suspended in a carrier liquid. In some such examples, the pulse of heat to heat the printing substance may cause the ink particles to melt. In some examples, the printing substance is a fluid.

In this example, following the provision of the printing substance on the photo-imaging cylinder 102, the photo-imaging cylinder 102 continues to rotate and transfers the printing substance, in the form of the image, to the transfer member 104. In some examples, the transfer member 104 is electrically charged to facilitate transfer of the image to the transfer member 104.

In some examples, the transfer member 104 is to transfer the image directly from the transfer member 104 to the substrate 108. In some examples where the electrophotographic printer is a liquid electrophotographic printer, the transfer member 104 may comprise a transfer blanket to transfer the image directly from the transfer blanket to the substrate 108. In other examples, a transfer component may be provided between the transfer member 104 and the substrate 108, so that the transfer member 104 is to transfer the image from the transfer member 104 towards the substrate 108, via the transfer component.

In this example, the transfer member 104 transfers the image from the transfer member 104 to a substrate 108 located between the transfer member 104 and an impression cylinder 114. This process may be repeated, if more than one coloured printing substance layer is to be included in a final image to be provided on the substrate 108.

The substrate 108 may, for example, be any coated or uncoated paper material suitable for electrophotographic printing. In some examples, the substrate 108 comprises a web formed from cellulosic fibres, having a basis weight of from about 75 gsm to about 350 gsm, and a calliper (i.e. thickness) of from about 4 mils (thousandths of an inch-around 0.1 millimetres) to about 200 mils (around 5 millimetres). In some examples, the substrate 108 includes a surface coating comprising starch, an acrylic acid polymer, and an organic material having an hydrophilic-lipophilic balance value of from about 2 to about 14 such as a polyglycerol ester. In other examples, the substrate 108 may take a different form to those described above.

The substrate 108 may be fed on a per sheet basis, or from a roll. The latter is sometimes referred to as a web substrate. In this example, the substrate 108 enters the printer 100 from one side of an image transfer region 116, shown on the right of FIG. 1. The substrate 108 may then pass over a feed tray 118 to the impression cylinder 114. In this example, as the substrate 108 contacts the transfer member 104, the image is transferred from the transfer member 104 to the substrate 108.

In this example, the creation and transfer of images, and the cleaning of the photo-imaging cylinder 102, is a continuous process. The system may have the capability to create and transfer hundreds of images per minute. In one example, the speed at which the printing substance is transferred to the substrate 108, a printing process speed, is more than 1000 mm/s. In some examples, the printing process speed is more than 2000 mm/s. In some examples, this speed may be the speed at which the substrate 108 is fed through the system 100.

The image transfer region 116 is a region between the transfer member 104 and the impression cylinder 114 where the impression cylinder 114 is in close enough proximity the transfer member 104 to apply a pressure to a back side of the substrate 108 (i.e. the side on which the image is not being formed), which then transmits a pressure to the front side the substrate 108 (i.e. the side on which the image is being formed). In some examples, a distance between the transfer member 104 and the impression cylinder 114 is adjustable to produce different pressures on the substrate 108 when the substrate 108 passes through the image transfer region 116, or to adjust the applied pressure when a substrate 108 of a different thickness is fed through the image transfer region 116.

To form a single colour printed image (such as a black and white image), one pass of the substrate 108 between the impression cylinder 114 and the transfer member 104 may complete the desired image. For a multi-colour image, the substrate 108 may be retained on the impression cylinder 114 and make multiple contacts with the transfer member 104 as the substrate 108 passes through the image transfer region 116. At each contact, an additional colour plane may be placed on the substrate 108.

For example, to generate a four-colour printed image, the photo charging unit 110 may form a second pattern on the photo-imaging cylinder 102, which then receives the second colour from a second BID unit 112. In the manner described above, this second pattern may be transferred to the transfer member 104 and impressed onto the substrate 108 as the substrate 108 continues to rotate with the impression cylinder 114. This process may be repeated until the desired image with all four colour planes is formed on the substrate 108. Following the complete formation of the desired image on the substrate 108, the substrate 108 may exit the machine or be duplexed to create a second image on the opposite surface of the substrate 108. In examples where the printer 100 is digital, the operator may change the image being printed at any time and without manual reconfiguration.

The gloss of the printed image is dependent on the uniformity of the printed layer of printing material on the substrate. A more uniform application of printing substance to the substrate results in a higher gloss level, as light is reflected in a more consistent manner from a uniform application of printing substance.

The optical density of the printed image on the substrate is dependent on the coverage of the printed layer of printing substance. A greater extent of coverage of printing substance on the substrate results in a higher optical density level.

A printed image on a substrate may be coated or treated on a special finishing device to improve the gloss and/or optical density of the printed image. However, each of these methods has disadvantages. For example, they come with added complexity, the requirement for dedicated additional equipment and therefore additional cost.

In accordance with some examples described herein, there is provided an electrophotographic printer comprising a transfer element to transfer an image from the transfer element towards a substrate; and a heater 200 to emit a pulse of heating energy to heat the image on the transfer element with a power density of at least 0.1 W/mm2.

Heating the printing substance on the transfer element by a pulse of heat may increase flowability of the printing substance on the transfer member. The is, the printing substance may flow more readily or freely. In some examples, the pulse of heat reduces the viscosity of the printing substance, due to the relationship between viscosity and temperature for printing substances. As the viscosity of the printing substance is lowered, the printing substance is able to form a more uniform layer when transferred to the substrate due to the higher fluidity and reduced surface tension of the printing substance. In some examples, particles within the printing substance may be melted by the pulse of heat. For example, in examples in which the printing substance comprises ink particles suspended in a carrier liquid, the ink particles may be melted by the application of the heat. In examples in which the printing substance is dry toner comprising ink particles in the form of a powder, the ink particles may be melted by the application of the heat. In some examples, emitting the pulse of heat to heat the printing substance is to create a uniform layer of the printing substance on the transfer member.

The pulse of heat to heat the printing substance on the transfer element is provided by a heater 200, which in some examples is a laser array. Providing heat with very high power density over a short period of application reduces heat losses in the electrophotographic printer, as components of the printer are not unnecessarily heated. That is, the short period of application of the heat means that the heat is absorbed substantially only by the printing substance. Thus, the proportion of the heat that is absorbed by components of the printer itself may be small or non-existent. Further, by heating with a high energy density, it is possible to increase the printing substance temperature rapidly to a required level even though the total amount of energy is relatively small. In some electrophotographic printers, the peak temperature of the image on the transfer member may reach approximately 110 degrees Celsius. This is in contrast with some examples, in which the emission of a pulse of heat with a high power density allows the temperature of the image on the transfer member to reach a temperature of greater than 120 degrees Celsius. In some examples, the temperature may be greater than 140 degrees Celsius. In some examples, the temperature may be greater than 200 degrees Celsius.

In some examples, the temperature of the transfer cylinder 106 is maintained at a substantially constant temperature while the image on the transfer blanket 106*a* is being heated by the pulse of heating energy. That is, the heater may be to emit the pulse of heating energy to heat the image on the transfer blanket 106*a* substantially without heating the transfer cylinder 106. For example, the change in temperature of the transfer cylinder 106 may be less than 10 degrees Celsius.

The pulse of heat is a burst of heating energy in which heat is delivered over a short period of time. In some examples, the pulse of heat is delivered for a period of less than 0.5 seconds. In some examples, the pulse of heat may be delivered for a period of less than 0.2 seconds. In some examples, the pulse of heat may be delivered for a period of less than 0.1 seconds. In some examples, the pulse of heat may be delivered for a period of less than 0.01 seconds. In some examples, the pulse of heat from the heater heats the printing substance within 0.1 seconds prior to the printing substance being transferred to the substrate 108. In some examples, the pulse of heat from the heater heats the printing substance within 0.05 seconds prior to the printing substance being transferred to the substrate 108. To heat the printing substance on the transfer member to the required temperature in a short space of time, the pulse of heat has a high power density. In some examples, the pulse of heat has a power density of at least 0.1 $W/mm^2$. In some examples, the heater may emit a pulse of heat with a power density of greater than 0.1 $W/mm^2$. In further examples, the pulse of heat has a power density of at least 0.5 $W/mm^2$. In further examples, the pulse of heat has a power density of at least 1.0 $W/mm^2$. In some examples, the pulse of heat has a power density of at least 1.2 $W/mm^2$. In some examples, the pulse of heat has a power density of at least 1.5 $W/mm^2$.

In some examples, a user is able to select the power density of the pulse of heat of the heater by operating a controller. The power density of the pulse of heat directly influences the temperature of the printing substance on the transfer member. The ability to control the peak temperature and temperature profile of the printing substance on the transfer member allows the control of the viscosity of printing substance across a range.

Figure 2:
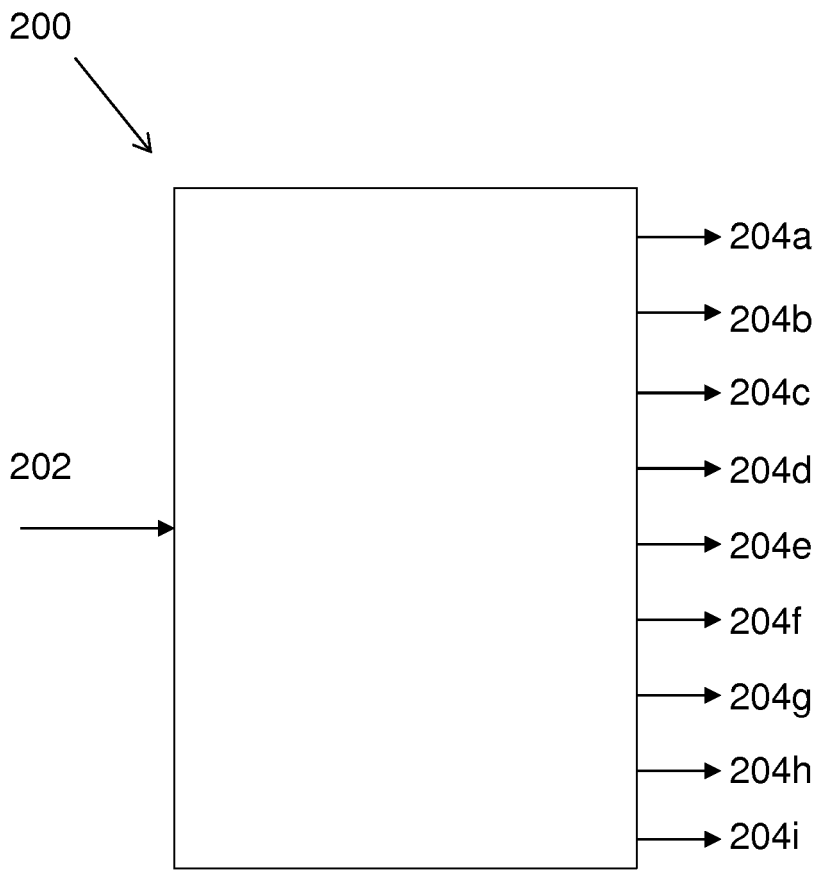
FIG. 2 is a schematic diagram showing a heater of an electrophotographic printer in accordance with an example.

The heater 200 shown in FIG. 1 may be implemented as shown in FIG. 2. The heater 200 of FIG. 2 is a laser array. In some examples, input power is applied to the laser array 200 via input 202. The laser array 200 may have a series of output lasers 204*a* to 204*i* to emit a pulse of heat to heat the printing substance on the surface of the transfer element. In some examples the laser array may have an output power of 10 W/mm.

Figure 3:
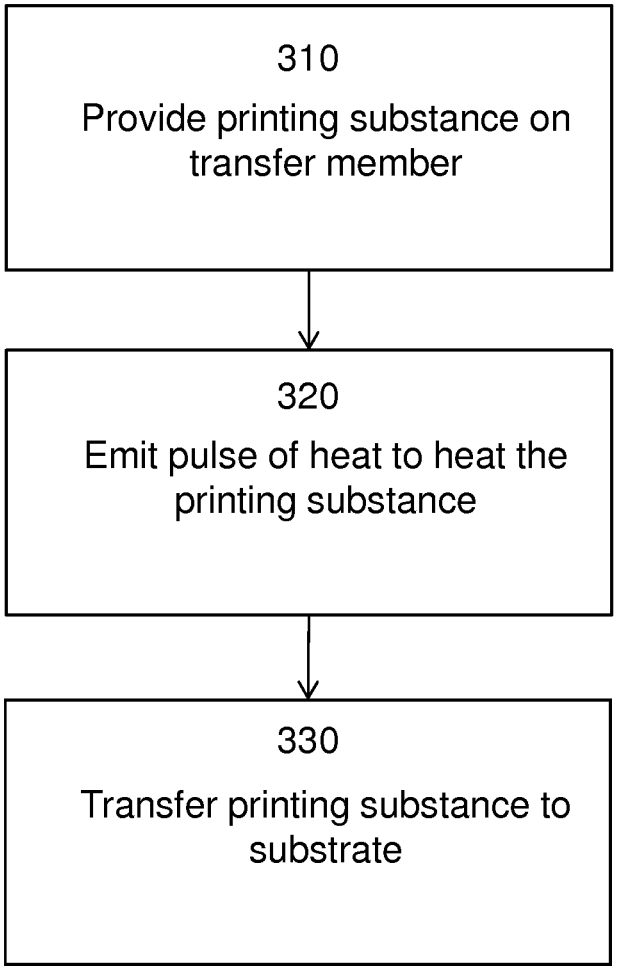
FIG. 3 is a flow diagram showing a method of operating an electrophotographic printer to control the optical density of a printed image on a substrate according to an example.

FIG. 3 shows a method of operating an electrophotographic printer to control the optical density of a printed image on a substrate according to an example.

At block 310, a printing substance is provided on a transfer member 104. The transfer member 104 may be electrostatically charged to facilitate the transfer of the printing substance. In some examples, the transfer member 104 comprises a transfer blanket 106*a* and the printing substance is provided on the transfer blanket 106*a*.

At block 320, a heater emits a pulse of heat to heat the printing substance on the transfer member 104 to increase the flowability of the printing substance on the transfer member 104. Increasing the flowability of the printing substance enables the printing substance to flow more freely on the substrate. The flowability of the printing substance may be increased in examples in which the printing substance is a liquid carrying solid particles, dry toner, a fluid, or the like. In some examples the heater is a laser array, such as the laser array 200 described with reference to FIG. 2. The laser array may provide a single pulse of heat to the printing substance. In some examples, the amount of heat delivered from the heater to the printing substance on the transfer member 104 is controllable by a controller. The controller may be user operated, allowing the user to select the desired temperature of the printing substance on the transfer member, and hence allow the user to control the ultimate optical density and gloss of the printing substance on the substrate. The heater may be to heat a first region of the printing substance on the transfer member to a first temperature and to heat a second region of the printing substance on the substrate to a second temperature. Heating the first and second regions to different temperature allows the gloss and optical density of the image on the substrate to vary across the image. For example, a picture within the image may require a higher level of glossiness and optical density as compared to text within the image. The region of the image on the transfer member comprising the picture may be selectively heated by the heater to a higher temperature as compared to the region of the image on the transfer member comprising the text. In some example, the heater may melt solid particles within the printing substance.

In some examples, the heater may emit a pulse of heat with a power density of at least 0.1 $W/mm^2$. In some examples, the heater may emit a pulse of heat with a power density of greater than 0.1 $W/mm^2$. In some examples, the heater may emit a pulse of heat with a power density of at least 0.5 $W/mm^2$. In some examples, the heater may emit a pulse of heat with a power density of at least 1.0 $W/mm^2$. In some examples, the heater may emit a pulse of heat with a power density of at least 1.2 $W/mm^2$. In some examples, the pulse of heat has a power density of at least 1.5 $W/mm^2$ In some examples, the printing substance on the transfer member 104 is heated by the pulse to a temperature of greater than 120 degrees Celsius. In some examples, the printing substance on the transfer member 104 is heated by the pulse to a temperature of greater than 140 degrees Celsius. In some examples, the printing substance on the transfer member 104 is heated by the pulse to a temperature of greater than 200 degrees Celsius.

At block 330, the printing substance is transferred from the transfer member 104 to a substrate 108. In LEP printing systems, this may be done using an impression cylinder 114. In some examples, the pulse of heat from the heater heats the printing substance within 0.1 seconds prior to the printing substance being transferred to the substrate 108. In some examples, the pulse of heat from the heater heats the printing substance within 0.05 seconds prior to the printing substance being transferred to the substrate 108.

Figure 4:
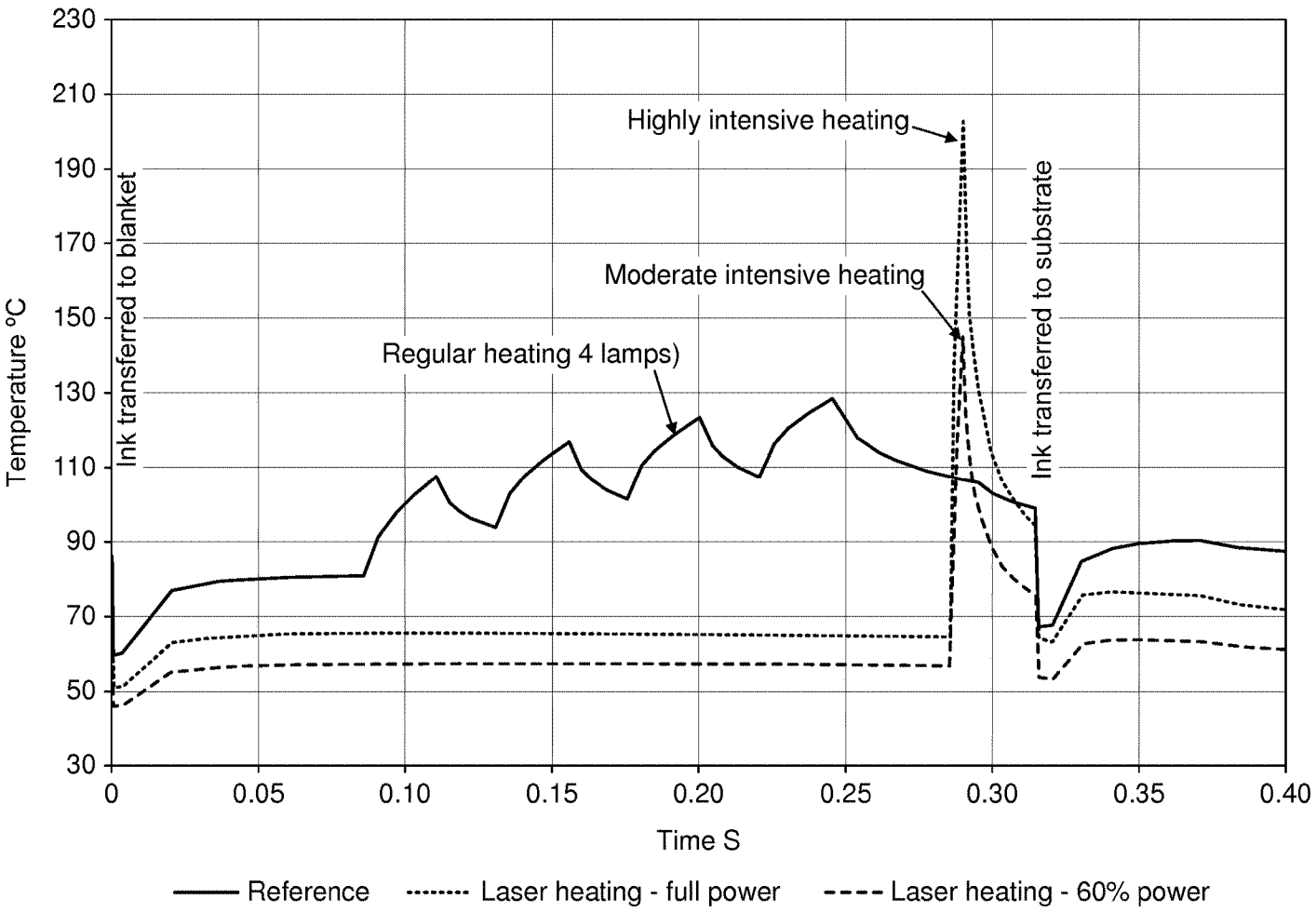
FIG. 4 is a graph showing the temperature of printing substances on transfer blankets as effected by different processes.

FIG. 4 is a graph showing variation over time of the temperature of printing substances on transfer blankets, as effected by different processes. The line labelled "regular heating" represents the temperature profile of ink that is heated by a heater comprising four lamps, which emit a constant supply of heat. As the transfer blanket upon which the ink is provided rotates, the ink passes by each of the four lamps in succession and is heated by each lamp to a maximum temperature of approximately 130 degrees Celsius. The temperature of the ink is raised over a period of approximately 0.2 seconds from approximately 80 degree Celsius to the temperature of approximately 130 degrees Celsius. As the lamps substantially constantly emit heat, a portion of the heat is lost to the surrounding atmosphere and/or to the other components of the electrophotographic printer.

The line labelled "moderate intensive heating" represents the temperature profile of a printing substance, in this example ink, on a transfer member, in the form of a transfer blanket, which is heated by a heater of a printer according to an example. In this example, the printing substance is heated by a pulse of heat from the heater to a temperature of greater than 140 degrees Celsius. The amount of heat delivered by the heater may be controllable by a user-operated controller. The user may therefore control the temperature of the printing substance on the transfer member, upon which temperature the optical density of the printed image is dependent. In this example, the printing substance is heated by a pulse of heat with a power density of 0.7 $W/mm^2$. In this example, the pulse of heat is applied within approximately 0.05 seconds prior to the printing substance being transferred from the transfer member to a substrate.

The line labelled "highly intensive heating" represents the temperature profile of a printing substance, in this example ink, on a transfer member, in the form of a transfer blanket, which is heated by a heater of a printer according to an example. In this example, the printing substance is heated by the heater to a temperature of greater than 200° C. by a pulse of heat with a power density of 1.2 $W/mm^2$. In this example, the pulse of heat is applied within approximately 0.05 seconds prior to the printing substance being transferred from the transfer member to the substrate. The application of highly concentrated heating energy to the printing substance just prior to its transfer to the substrate reduces energy losses to the bulk of the printer. As the pulse of heat is applied over a very short period of time, for example less than 0.1 s, the overall energy required to heat the printing substance can be reduced compared with other heating techniques.

Figure 5A:
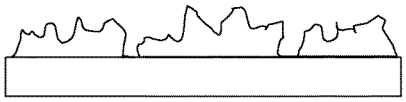
FIG. 5A illustrates the side profile of a layer of printing substance.
Figure 5B:
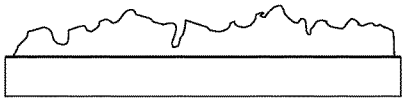
FIG. 5B illustrates the side profile of a layer of printing substance printed according to an example.

FIG. 5A illustrates the side profile of a layer of printing substance. It can be seen from FIG. 5A that the layer of printing substance is non-uniform. There are multiple voids in the layer of printing substance, which appear to observer as a white spots. FIG. 5B illustrates the side profile of a layer of printing substance printed according to an example, in which a heater emits a pulse of heat to heat the printing substance on a transfer member, resulting in the flowability of the printing substance being increased. As the flowability of the printing substance is increased, the printing substance is able to flow more freely, so that the number of voids in the printed image is reduced without the need for extra printing separations or an increased amount of printing substance to produce higher optical density.

Figure 6A:
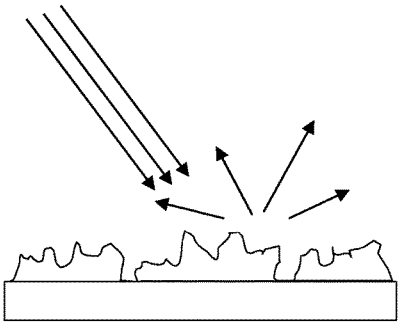
FIG. 6A illustrates the reflection of light from the layer of printing substance shown in FIG. 5A.
Figure 6B:
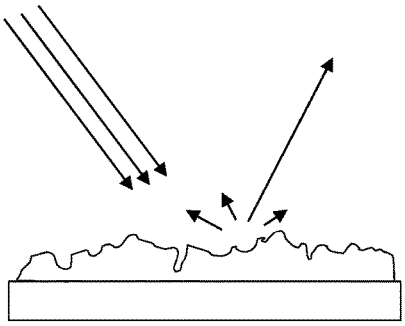
FIG. 6B illustrates the reflection of light from the layer of printing substance shown in FIG. 5B.

FIG. 6A illustrates the reflection of light from a layer of printing substance shown in FIG. 5A. The layer of printing substance has a rough surface, so that light incident on the surface is scattered, resulting in a relatively low gloss value. FIG. 6B illustrates the reflection of light from the layer of printing substance shown in FIG. 5B. The layer of printing substance has a smooth surface, so that light incident on the surface is specular, resulting in a higher gloss value.

Figure 7A:
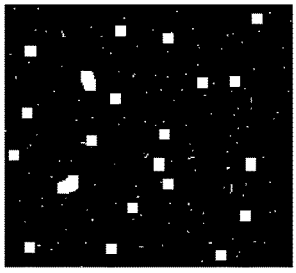
FIG. 7A shows a scan of a printed image printed using an electrophotographic printer.

FIG. 7A shows a scan of a printed image printed using an electrophotographic printer, in which the printing substance used to form the printed image in heated on a transfer member by four radiant heating lamps. The image shown in FIG. 7A has a relatively large number of white spots, due to incomplete printing substance formation.

Figure 7B:
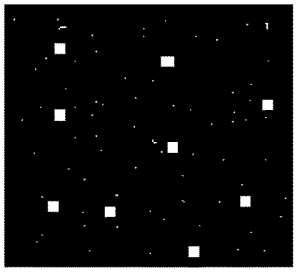
FIG. 7B shows a scan of a printed image printed using an electrophotographic printer according to an example.

FIG. 7B shows a scan of a printed image printed using an electrophotographic printer according to an example, in which a heater emits a pulse of heat with a power density of 0.7 W/mm$^2$ to heat the printing substance on the transfer member. There are fewer white spots in the image of FIG. 7B than in the image of FIG. 7A.

Figure 7C:
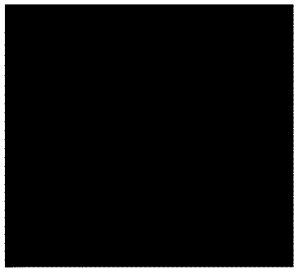
FIG. 7C shows a scan of a printed image printed using an electrophotographic printer according to an example.

FIG. 7C is the scan of a printed image printed using an electrophotographic printer according to an example, in which a heater emits a pulse of heat with a power density of 1.2 W/mm$^2$ to heat the printing substance on the transfer member. There are fewer white spots in the image in FIG. 7C than in the images in FIG. 7A and FIG. 7B.

In some examples, heating the printing substance on the transfer element by a pulse of heat reduces the viscosity of the printing substance, due to the relationship between viscosity and temperature for printing substances. As the viscosity of the printing substance is lowered, the printing substance is able to form a more uniform layer when transferred to the substrate due to the higher fluidity and reduced surface tension of the printing substance.

The preceding description has been presented to illustrate and describe examples of the principles described. This description is not intended to be exhaustive or to limit these principles to any precise form disclosed. Many modifications and variations are possible in light of the above teaching.

What is claimed is:

1. A method of operating an electrophotographic printer to control the optical density of a printed image, the method comprising:

providing a printing substance on a transfer member;

emitting a pulse of heat having a power density of at least 0.1 W/mm$^2$ to heat the printing substance on the transfer member for a period of less than 0.5 seconds to increase flowability of the printing substance on the transfer member prior to the printing substance being transferred to a substrate; and transferring, from the transfer member to the substrate, the printing substance heated by the pulse of heat so as to provide the printed image on the substrate.

2. The method according to claim 1, wherein the transfer member comprises a transfer blanket.

3. The method according to claim 1, wherein the printing substance is a liquid comprising solid particles suspended therein, and wherein the emitting comprises emitting the pulse of heat to melt the solid particles within the printing substance.

4. The method according to claim 1, wherein the emitting comprises emitting the pulse of heat to heat the printing substance within 0.1 seconds prior to the printing substance being transferred to the substrate.

5. The method according to claim 1, wherein the emitting comprises emitting the pulse of heat to heat the printing substance to create a uniform layer of the printing substance on the transfer member.

6. The method according to claim 1, wherein a printing process speed of the electrophotographic printer is at least 1000 mm/s.

7. The method according to claim 1, wherein the emitting comprises emitting the pulse of heat with a power density of 0.7 W/mm$^2$ for a period of less than 0.1 seconds within 0.05 seconds prior to the printing substance being transferred to the substrate.

8. The method according to claim 1, wherein the emitting comprises emitting the pulse of heat with a power density of 1.2 W/mm$^2$ for a period of less than 0.1 seconds within 0.05 seconds prior to the printing substance being transferred to the substrate.

9. The method according to claim 1, wherein the emitting comprises emitting the pulse of heat to heat a first region of the printing substance on the transfer member to a first temperature and to heat a second region of the printing substance on the transfer member to a second temperature different than the first temperature.

10. An electrophotographic printer comprising:

a transfer element to transfer an image from the transfer element to a substrate; and a heater to emit a pulse of heating energy with a power density of at least 0.1 W/mm$^2$ for a period of less than 0.5 seconds to heat the image on the transfer element prior to the image being transferred to the substrate.

11. The electrophotographic printer according to claim 10, wherein the transfer element comprises a transfer cylinder and a transfer blanket surrounding the transfer cylinder, and wherein the heater is to emit the pulse of heating energy to heat the image on the transfer blanket substantially without heating the transfer cylinder.

12. The electrophotographic printer according to claim 10, wherein the heater is to emit a pulse of heating energy with a power density of 0.7 W/mm$^2$ for a period of less than 0.1 seconds to heat the image on the transfer member element within 0.05 seconds prior to the image being transferred to the substrate.

13. The electrophotographic printer according to claim 10, wherein the heater is to emit a pulse of heating energy with a power density of 1.2 W/mm$^2$ for a period of less than 0.1 seconds to heat the image on the transfer member element within 0.05 seconds prior to the image being transferred to the substrate.

14. An electrophotographic printer to control the optical density of a printed image, the electrophotographic printer being to:

provide a printing substance on a transfer member;

emit a pulse of heat having a power density of at least 0.1 W/mm$^2$ to heat the printing substance on the transfer member for a period of less than 0.5 seconds to increase flowability of the printing substance on the transfer member prior to the printing substance being transferred to a substrate; and transfer, from the transfer member to the substrate, the printing substance heated by the pulse of heat so as to provide the printed image on the substrate.

15. The electrophotographic printer according to claim 14, wherein the pulse of heat is to heat the printing substance on the transfer member to a temperature of greater than 140 degrees Celsius.

16. The electrophotographic printer according to claim 14, wherein the electrophotographic printer is a liquid electrophotographic printer, and the transfer member comprises a transfer blanket to transfer the printing substance directly from the transfer blanket to the substrate.

17. The electrophotographic printer according to claim 14, wherein the pulse of heat is to heat the printing substance on the transfer member to a temperature of greater than 200 degrees Celsius.

* * * * *